US008646672B2

(12) United States Patent
Wu et al.

(10) Patent No.: US 8,646,672 B2
(45) Date of Patent: Feb. 11, 2014

(54) NAIL POSITIONING MEMBER OF NAIL SLOT OF NAIL GUN

(75) Inventors: I-Tsung Wu, Taipei Hsien (TW); Po-Feng Huang, Taipei Hsien (TW); Yi-Zhuo Zhang, Tianjin (CN)

(73) Assignees: Depoan Pneumatic Corp., New Taipei (TW); Robert Bosch Tool Corporation, Mount Prospect, IL (US)

( * ) Notice: Subject to any disclaimer, the term of this patent is extended or adjusted under 35 U.S.C. 154(b) by 536 days.

(21) Appl. No.: 13/041,411

(22) Filed: Mar. 6, 2011

(65) Prior Publication Data

US 2012/0187176 A1 Jul. 26, 2012

(30) Foreign Application Priority Data

Jan. 24, 2011 (TW) ..... 100201530 U

(51) Int. Cl.
*B25C 5/02* (2006.01)
*B25C 5/06* (2006.01)

(52) U.S. Cl.
USPC ..... 227/119; 227/109; 227/120

(58) Field of Classification Search
USPC ..... 227/119–139, 8, 156; 173/118–120, 173/213
See application file for complete search history.

(56) References Cited

U.S. PATENT DOCUMENTS 5,522,533 A * 6/1996 Mukoyama et al. ..... 227/109
5,615,819 A * 4/1997 Hou et al. ..... 227/109
5,934,539 A * 8/1999 Lee ..... 227/109
6,161,746 A * 12/2000 Wey ..... 227/109
6,644,530 B2 * 11/2003 Chen ..... 227/109
6,715,657 B2 * 4/2004 Chen ..... 227/120
6,837,414 B1 * 1/2005 Chou ..... 227/109
7,004,368 B1 * 2/2006 Chen ..... 227/120
7,086,573 B1 * 8/2006 Wen ..... 227/8
7,273,160 B2 * 9/2007 Wey ..... 227/125
7,726,534 B2 * 6/2010 Chou et al. ..... 227/120
8,083,116 B2 * 12/2011 Liang ..... 227/8
2003/0121948 A1 * 7/2003 Hsien ..... 227/120
2003/0201300 A1 * 10/2003 Chen ..... 227/120
2005/0121490 A1 * 6/2005 Sun ..... 227/120
2006/0118594 A1 * 6/2006 Chen ..... 227/120
2009/0026244 A1 * 1/2009 Huang ..... 227/119
2009/0050667 A1 * 2/2009 Po ..... 227/120
2010/0230463 A1 * 9/2010 Yang ..... 227/109
2012/0187175 A1 * 7/2012 Wu et al. ..... 227/8

FOREIGN PATENT DOCUMENTS

TW 424653 3/2001
TW 561963 11/2003
TW M3456831 U 12/2008

* cited by examiner

*Primary Examiner* — Robert Long
(74) *Attorney, Agent, or Firm* — Chun-Ming Shih

(57) ABSTRACT

A nail positioning member of a nail slot of a nail gun includes a magazine including a horizontal nail slot connected with a perforation for nailing; a nail pushing piece slidably assembled to the nail slot; a plurality of horizontal slot channels parallel to the nail slot; and a plurality of positioning pieces, respectively pivotally assembled to the slot channels to block the head of the nails. The positioning piece forms a protruding portion in a movement path of the nail pushing piece, to be pushed by the nail pushing piece and to drive the positioning piece to oscillate in the direction of the slot channel in order to open the nail slot for placing the nails.

6 Claims, 6 Drawing Sheets

NAIL POSITIONING MEMBER OF NAIL SLOT OF NAIL GUN

BACKGROUND

1. Technical Field

The present invention relates to a nailing positioning member of a nail slot of a nail gun. More particularly, the present invention relates to a nail slot inside of a magazine, a nail pushing piece inside of the nail slot, slot channels inside of the magazine and positioning pieces.

2. Related Art

The gas-driven nail gun is a tool which uses high pressure to drive the nail. Nail guns in the market are usually capable of using nails of different length. Users can choose, according to the position or shape of the work piece to be nailed, a row of nails of appropriate length to fill into the magazine of the nail gun to drive the nail into the surface of the work piece. To use a single magazine to fill in a row of nails in different length, traditionally a nail positioning device is provided in a horizontal nail slot connected to a perforation for nailing in the magazine. The nail positioning device is provided to adjust the height of the horizontal nail slot capable of storing the row of nails in to let nails of different length filled in the single magazine preparing for nailing.

The traditional nail positioning device in the nail slot mentioned above are disclosed in Taiwanese patents 424653, M256812 and M345683, which use a plurality of strip members with elastic pushing force slidably assembled in the magazine to check the length and the nails and use the stripe members which are not connected with the body of the nail and close to the nail head to control the height of the nail slot. The disadvantage is that a plurality of elastic strip members is complicated for design and arrangement, which makes it difficult to decrease the manufacture cost and assembly time. In addition, the stripe members close to the nail head only have the function of separating the nail slot, which causes nails from moving laterally, being inclined or shaking because of the different dimensional accuracy of the nails and as a result, causes the nail jammed in the nail gun.

In addition, another positioning device of the nail slot has disclosed in Taiwanese patent 561963. In that patent, a plurality of horizontal slot channels 24*d* connected to the nail slot 20*d* are provided in a magazine 2*d* (as shown in FIG. 11). The slot channels include a pressing strip 7*d* and two springs 51*d* and 52*d*. The pressing strip 7*d* includes a vertical guiding aperture 71*d* and a vertical guiding ditch 72*d* on both ends. The pressing strip 7*d* accompanies the guiding aperture 71*d* and the vertical guiding ditch 72*d* to be respectively guided by a guiding column 25*d* and a guiding piece 26*d* at the ends of the magazine 2*d*. Simultaneously, both ends of the pressing strip 7*d* are respectively pushed by the springs 51*d* and 52*d* to move horizontally in the direction of the nail slot 20*d*. As a result, the pressing strip 7*d* pushes the row of nails and controls the height of the nail slot 20*d*. One end of the bottom of the pressing strip 7*d* away from the perforation 12*d* include a protruding portion 73*d* exposed in the nail slot 20*d*. The pressing strip 7*d* is capable of being pushed by the nail pushing piece accompanying with the protruding portion 73*d* to move in the direction of the slot channel 24*d* in order to open the nail slot 20*d* for placing the nails. The disadvantage is that the point of application of a force by the nail pushing piece to the pressing strip 7*d* focuses on the protruding portion 73*d* of one end of the pressing strip 7*d* away from the perforation 12*d*. The other end of the pressing strip 7*d* close to the perforation 12*d* can also be pushed by the spring 51*d* and as a result, cannot move into the slot channel 24*d* completely, which may cause the pressing strip swung and the nail slot 20*d* not completely opened.

BRIEF SUMMARY

The present application is designed to solve the issue that the nail positioning member is complicated for design and arrangement. The present application is designed to prevent nails from moving laterally, being inclined or shaking and as a result to prevent the nail from being jammed in the nail gun. The present application is also designed to solve the issue that the nail slot is not completely opened.

The present application provides a nail positioning member of a nail slot of a nail gun, comprising: a magazine including a horizontal nail slot, the nail slot including a plurality of row-shaped nails and being connected with a perforation for nailing at the bottom of a gun body of the nail gun; a nail pushing piece, bearing an elastic force in the direction of the perforation to slidably assembled to the nail slot; a plurality of horizontal slot channels parallel to each other, the slot channels being formed in the magazine, being connected to the nail slot and being parallel to the nail slot; and a plurality of positioning pieces, respectively assembled to the slot channels, both ends of each positioning piece being provided with a nail pushing position close to the perforation and a pivotal portion away from the perforation, each positioning piece bearing an elastic force to be pivotally connected to the nail slot by the pivotal portion, and in turn to drive the nail pushing portion to oscillate in the direction of the nail slot to a first position capable of blocking a nail head of the nail, the positioning piece between the nail pushing portion and the pivotal portion forming a protruding portion in a movement path of the nail pushing piece, the nail pushing piece, away from the protruding portion, pushing the protruding portion and driving the nail pushing portion to oscillate in the direction of the slot channel to a second position capable of opening the nail slot for placing the nails.

As a result, the nail pushing piece can push or discharge the protruding portion accompanying with the opening and closing action of the magazine, drive the nail pushing portion to oscillate to a first position or a second position, and control the height of the nail slot to limit the movement of the nails. This can solve the issue mentioned above that the nail pushing piece focuses the force on one end of the pressing strip away from the perforation, which may cause the pressing strip swung and the nail slot 20*d* not completely opened.

In addition, in the present application, the slot channel is connected with the perforation, and the nail pushing portion of the positioning piece extends to the gun body close to the perforation.

The inside wall of the nail channel and the nail pushing portion forms a spring in between, and the positioning piece bears an elastic force by the spring. The positioning piece bears the elastic force and is pivotally assembled to the magazine. A single spring is used to drive the positioning piece to oscillate. This can simplify the number of the positioning members, which can save the manufacture cost and increase the manufacture efficiency.

The inside wall of the slot channel forms a positioning aperture capable of locating the spring, and the spring is positioned inside of the positioning aperture.

The nail pushing portion is driven by the spring in the direction of the nail slot and push the body of the nail in the nail slot. This can prevent nails in the magazine from moving laterally, being inclined or shaking in order to prevent the nail gun from being jammed by nails and to increase the reliability of the nailing of the nail gun.

The protruding portion is exposed in the nail slot and on the movement path of the nail pushing piece.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Hereinafter, the present invention will be described in detail with reference to the accompanying drawings. It should be understood that drawings do not limit the scope of the present invention.

Figure 1:
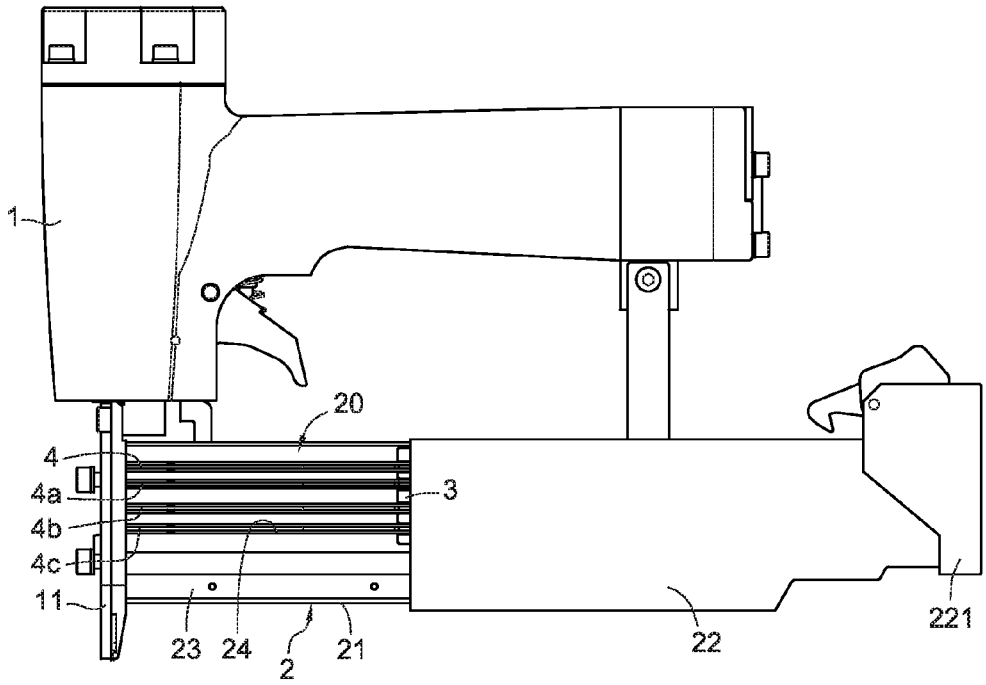
FIG. 1 is a front view of one embodiment of the present application.
Figure 4:
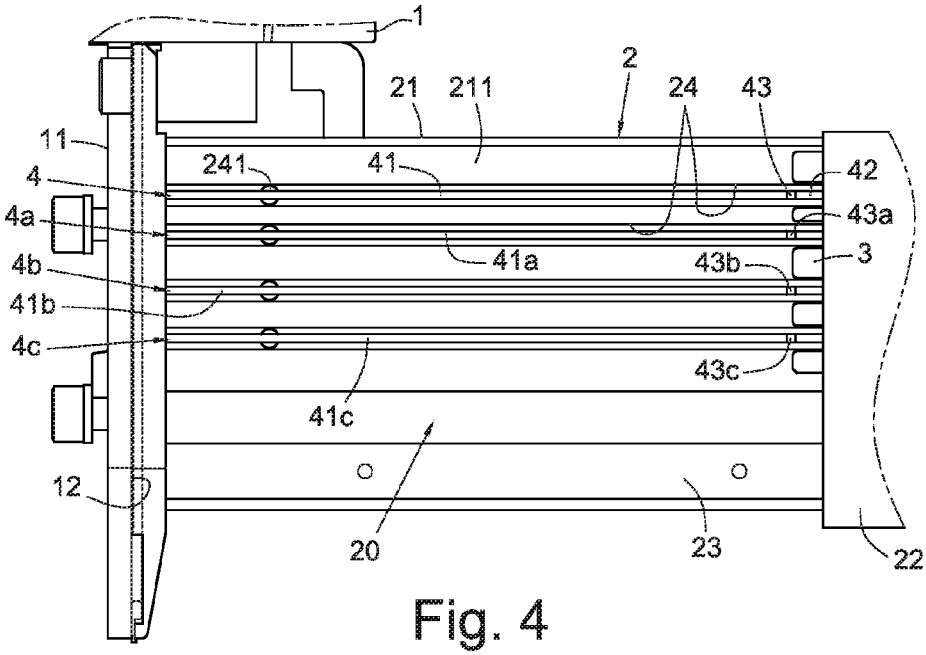
FIG. 4 is a partially amplified view of the magazine in FIG. 1.
Figure 5:
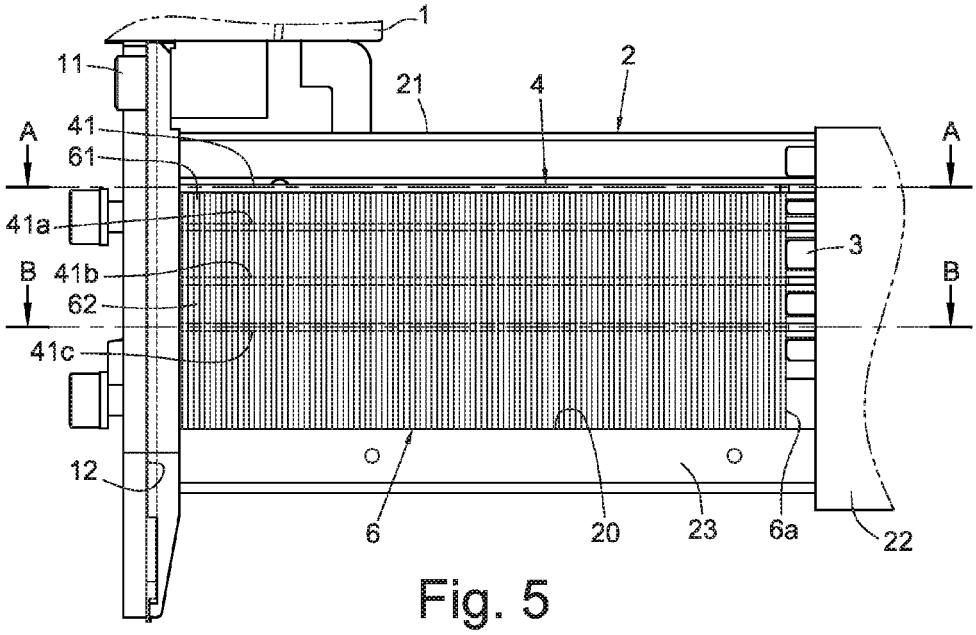
FIG. 5 is an action view of FIG. 4.
Figure 6:
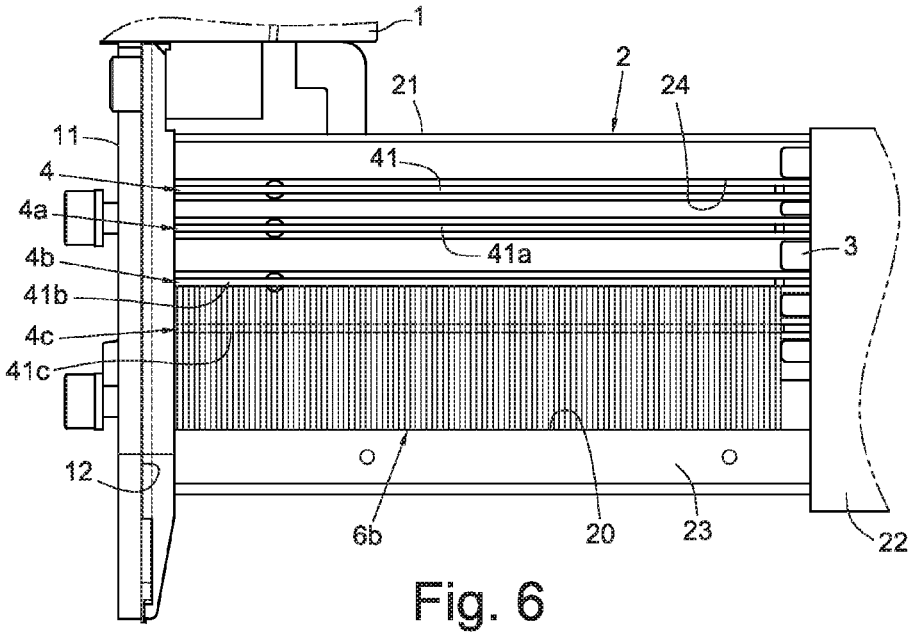
FIG. 6 is another action view of FIG. 4.
Figure 7:
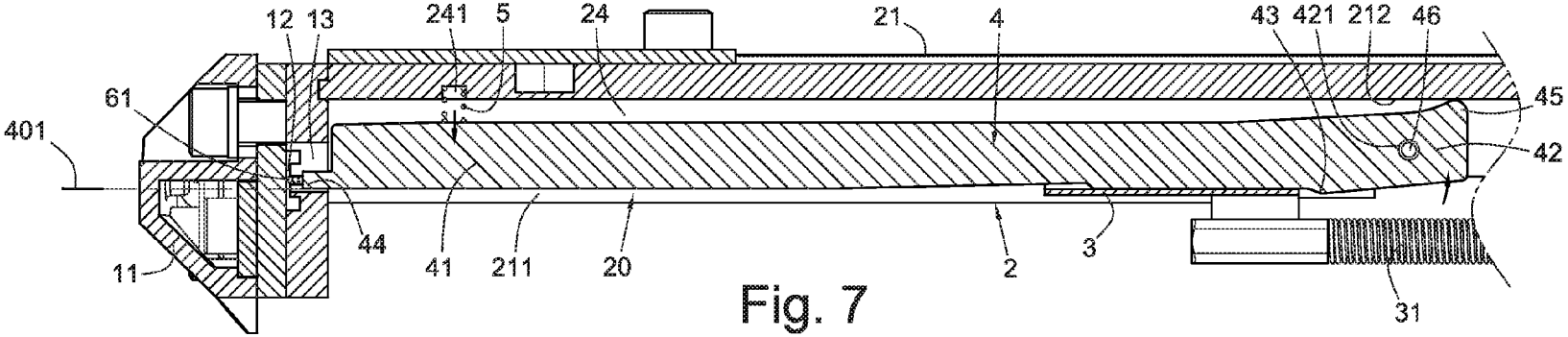
FIG. 7 is the A-A cutaway view of FIG. 5.

FIG. 1 is a front view of one embodiment of the present invention. As shown in FIG. 1 accompanying with FIG. 2 and FIG. 4, a nail positioning member of a nail slot of a nail gun may comprise a magazine 2, a nail pushing piece 3, a plurality of horizontal slot channels 24 parallel to each other, a plurality of positioning pieces 4, 4*a*, 4*b*, 4*c* provided in the slot channels 24 and a plurality of compressed spring 5. The magazine 2 may be provided on the side of a gun muzzle 11 which is at the bottom of the gun body 1 of the nail gun. The magazine 2 may include a base 21 connected to the side of the muzzle 11 and a sliding cover 22 slidably assembled to an inside wall 211 of the base 21. An anti-abrasive board 23 may be provided at the bottom of the inside wall 211 of the base 21. The inside wall 211 of the base 21, the top surface of the anti-abrasive board 23 and the inside wall of the sliding cover 22 may form a horizontal nail slot 20 (as shown in FIG. 7) capable of installing a row of long nails 6 or short nails 6*b* (as shown in FIG. 5 and FIG. 6). The muzzle 11 may include a perforation 12 for nailing. The side end of the muzzle 11 and the perforation 12 may be connected with a nail feeding opening 13. The nail slot 20 and the perforation 12 may be connected by the nail feeding opening 13.

Figure 2:
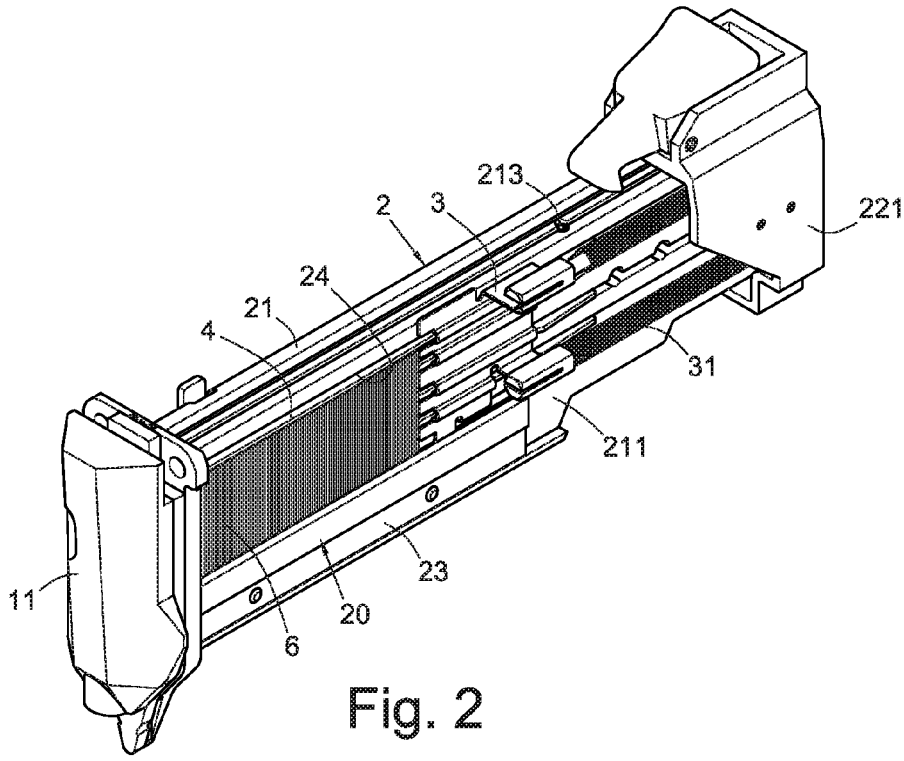
FIG. 2 is a perspective view of the magazine in FIG. 1.
Figure 3:
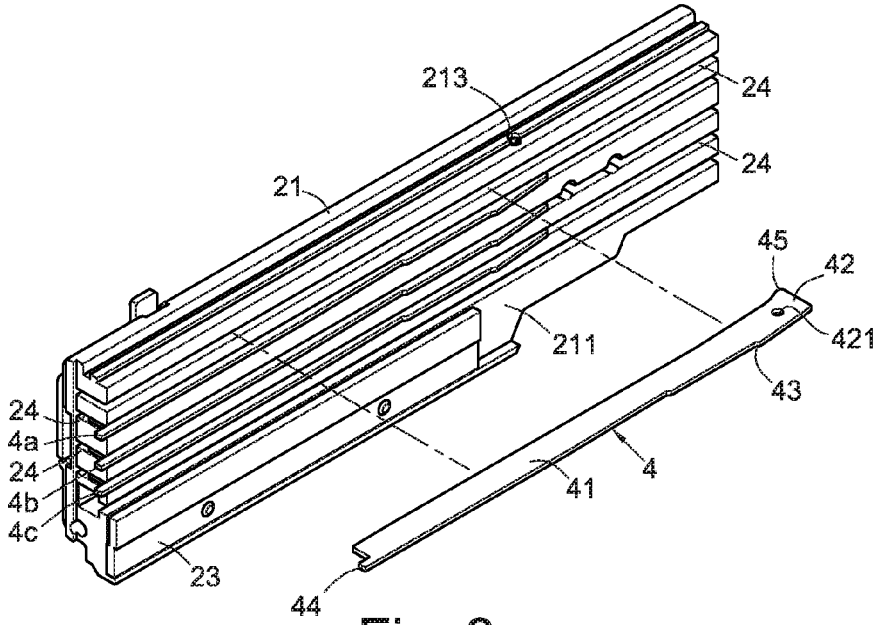
FIG. 3 is a perspective exploded view of the base in FIG. 1.

The nail pushing piece 3 may be mounted inside of the nail slot 20 (as shown in FIG. 1 and FIG. 2). Two compressed spring 31 may be mounted between the inside wall of an end portion 221 of the sliding cover 22 and the nail pushing piece 3. The nail pushing piece 3 may be slidably assembled to the nail slot 20. The nail pushing piece 3 may bear the elastic force in the direction of the perforation 12. In this embodiment, the nail pushing piece 3 may be slidably assembled to the inside wall of the sliding cover 22 and may be capable of moving in or out of the nail slot 20 when the sliding cover 22 opens or closes the magazine 2. As a result, the nail pushing piece 3 may be able to be driven by the spring 31 to push a plurality of long nails 6 or short nails 6*b* one by one to the perforation 12 to prepare for nailing (as shown in FIG. 5 and FIG. 6). The slot channels 24 may be arranged from top to bottom on the inside wall 211 of the base 21 of the magazine 2 (as shown in FIG. 3, FIG. 4 and FIG. 7). The slot channels 24 may respectively be connected with the nail slot 20. The nail slot 20 may be parallel to the slot channels 24. The perforation 12 may be connected with one end of the slot channels 24. The distances between the slot channels 24 are designed according to the length of long or short nails of the ordinary use.

The positioning piece 4, 4*a*, 4*b* and 4*c* may be arranged from top to bottom inside of the slot channels 24 (as shown in FIG. 3, FIG. 4 and FIG. 7). The number of the positioning piece may be equal or less than the number of the slot channels 24. The positioning piece 4, on its both ends, may respectively form a nail pushing portion 41 near the perforation 12 and a pivotal portion 42 away from the perforation 12. The positioning piece 4 may bear the elastic force and may be pivotally connected to the position away from the perforation 12 by the pivotal portion 42. In one embodiment, a plurality of vertical apertures 213 throughout the slot channels 24 may be formed close to the end portion 221 of the base 21. The aperture 213 may be provided with an axle rod 46 inside. The pivotal portion 42 may be provided with a horizontal axle aperture 421. The pivotal portion 42 may be mounted on the axel rod 46 by the axle aperture 421 and may be, in turn, pivotally connected to the slot channel 24. The nail pushing portion 41 of the positioning piece 4 may form an ear portion 44 extending into the nail aperture 13. The ear portion 44 may be close to perforation 12 which is at the bottom of the gun body 1. The nail feeding opening 13 may be capable of limiting the oscillation of the ear portion 44 to limit the oscillation amplitude of the positioning piece 4. The pivotal portion 42 of the positioning piece 4 may form, on its side, an arc convex portion 45 close to the inside wall 212 at the top of the base 21. The inside wall 212 of the base 21 may be capable of restraining the oscillation of the arc convex portion 45 to limit the oscillation amplitude of the positioning piece 4. The positioning piece 4 which is between the nail pushing portion 41 and the pivotal portion 42 may form a protruding portion 43 on the movement path of the nail pushing piece 3. The protruding portion 43 may be exposed in the nail slot 20 from the slot channel 24. The movement path is the path where the nail pushing piece 3 is moved horizontally to and from the perforation 12 along the nail slot 20.

The positioning pieces 4*a*, 4*b* and 4*c* have the same structure and shape as the positioning piece 4 (as shown in FIG. 4). The different feature is the height of positioning pieces 4*a*, 4*b* and 4*c* in the nail slot 20.

Figure 8:
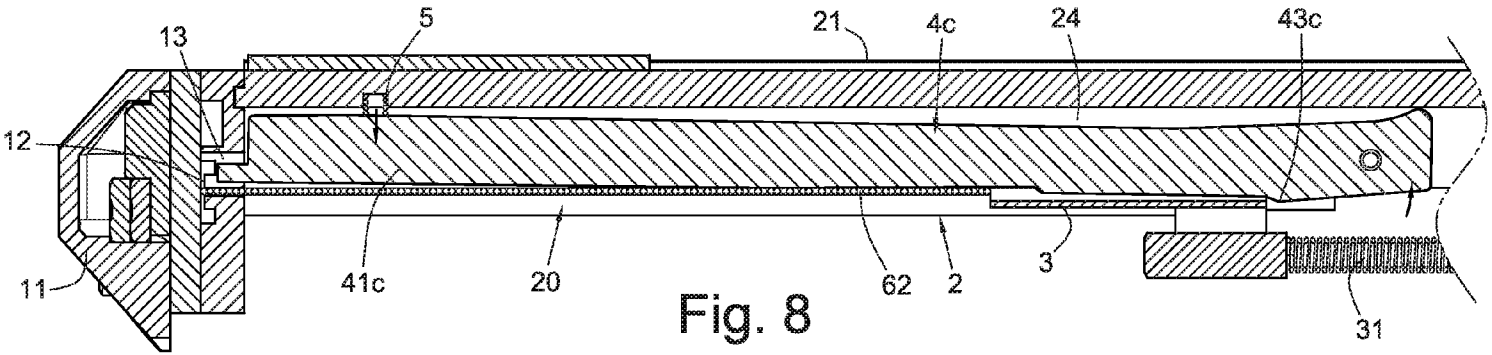
FIG. 8 is the B-B cutaway view of FIG. 5.

The spring 5 may be respectively between the inside wall of the slot channel 24 and the nail pushing portion 41, 41*a*, 41*b*, 41*c* of the positioning pieces 4, 4*a*, 4*b* and 4*c* (as shown in FIG. 7). The positioning pieces 4, 4*a*, 4*b* and 4*c* may bear the elastic force by the spring 5. The inside wall of the slot channels 24 is provided with a positioning aperture 241 to locate the spring 5 (as shown in FIG. 4). The spring 5 may be positioned inside of the positioning aperture 241 which is to limit the movement of the spring 5. As a result, the spring 5 may drive the nail pushing portion 41,41*a*, 41*b* and 41*c* of the positioning piece 4, 4*a*, 4*b* and 4*c* to oscillate in the direction of the nail slot 20 to a first position 401 of the nail head 61 which is to block the long and short nails (as shown in FIG. 5). Alternatively, the nail pushing portions 41*a*, 41*b*, 41*c* of the positioning pieces 4*a*, 4*b* and 4*c* may be driven by the spring 5 to move in the direction of the nail slot 20 and to push the nail body 62 of the nail 6 which is inside of the nail slot 20 (as shown in FIG. 8).

Figure 10:
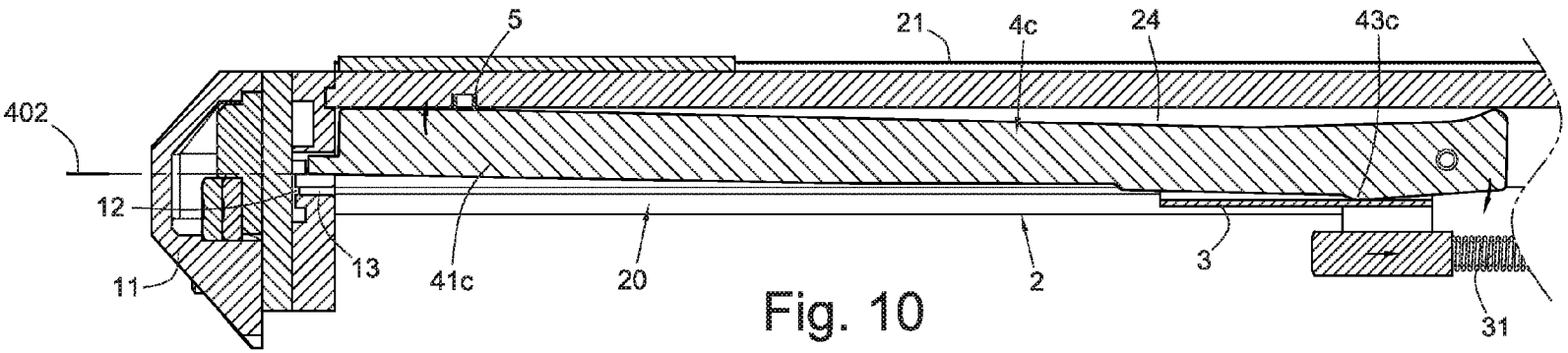
FIG. 10 is one action view of FIG. 9.
Figure 11:
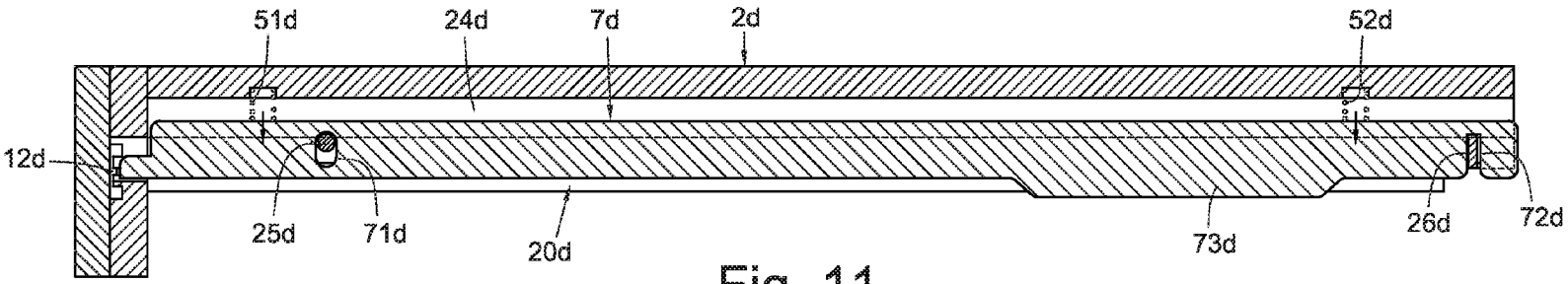
FIG. 11 is a cutaway view of a traditional magazine.
Figure 12:
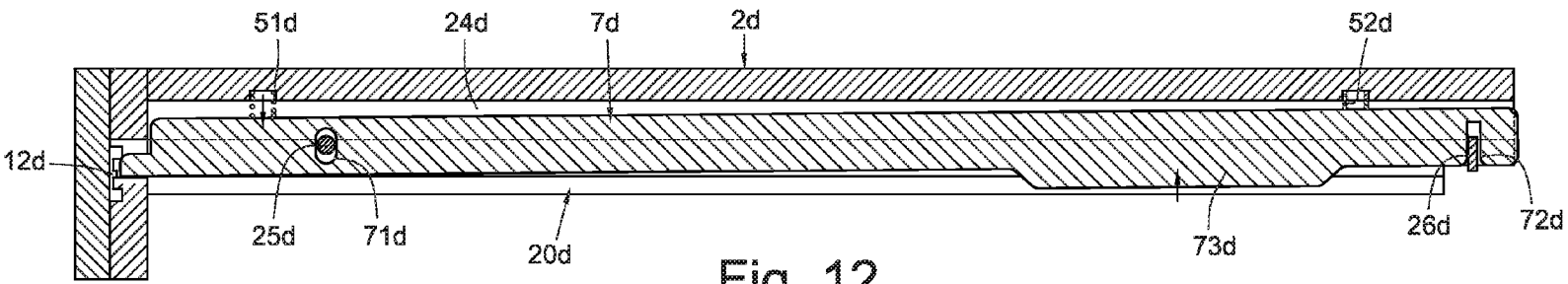
FIG. 12 is one action view of FIG. 11.

The nail pushing piece 3 which is inside of the nail slot 20 and away from the perforation 12 may be capable of pushing the convex portion 43, 43*a*, 43*b* and 43*c* of the positioning pieces 4, 4*a*, 4*b* and 4*c* (as shown in FIG. 10) to drive the nail pushing portion 41, 41*a*, 41*b* and 41*c* of the positioning piece 4, 4*a*, 4*b* and 4*c* to oscillate in the direction of the slot channels 24 to a second position 402 which is capable of opening the nail slot 20 and placing the long nails 6 or short nails 6*b*.

The operation of the structure mentioned above may comprise the steps of:

1. opening the sliding cover 22 of the nail magazine 2 (as shown in FIG. 1 and FIG. 4) to drive the nail pushing piece 3 away from the perforation 12, thus simultaneously pushing the protruding portions 43, 43*a*, 43*b* and 43*c* of the positioning piece 4, 4*a*, 4*b* and 4*c* by the nail pushing piece 3 (as shown in FIG. 10) and driving the nail pushing portion 41,41*a*,41*b* and 41*c* to simultaneously oscillate in the direction of the slot channels 24 to the second position 402 to open the nail slot 20 for placing long or short nails.

2. when the user fills a row of long nails 6 in the nail slot 20 (as shown in FIG. 5), locating the nail head 61 of the long nail 6 below the side of the nail pushing portion 41 of the positioning piece 4 and locating the nail body 62 of the long nail 6 to the side of nail pushing portion 41*a*, 41*b* and 41*c* of the positioning pieces 4*a*, 4*b* and 4*c*.

3. closing the sliding cover 22 of the nail magazine 2 to drive the nail pushing piece 3 to move in the direction of the perforation 12, in turn emancipating the protruding portion 43, 43*a*, 43*b* and 43*c* of the positioning pieces 4, 4*a*, 4*b* and 4*c* (as shown in FIG. 7), as a result, respectively driving the nail pushing portion 41, 41*a*, 41*b* and 41*c* of the positioning pieces 4, 4*a*, 4*b* and 4*c* by the spring 5 to oscillate in the direction of the nail slot 20. The nail pushing portion 41 of the positioning piece 4 may oscillate to the first position 401 and may be above the nail head 61 of the long nail 6 to prevent the nail head 61 from moving up. As a result, the long nail 6 may be between the bottom of the nail pushing portion 41 and the top of the anti-abrasive board 23 to limit the movement of the long nail 6 from above to bottom and to control the height of the nail slot 20. The nail pushing portion 41*a*, 41*b* and 41*c* of the positioning pieces 4*a*, 4*b* and 4*c* may be pushed to the nail body 62 of the long nail 6 (as shown in FIG. 8) to prevent the long nail 6 from moving laterally, being inclined or shaking in order to prevent the nail gun from being jammed by nails. Simultaneously, the nail pushing piece 3 may elastically the last short nail 6*a* (as shown in FIG. 5) to push the long nail 6 one by one to the perforation 12 waiting for nailing.

Figure 9:
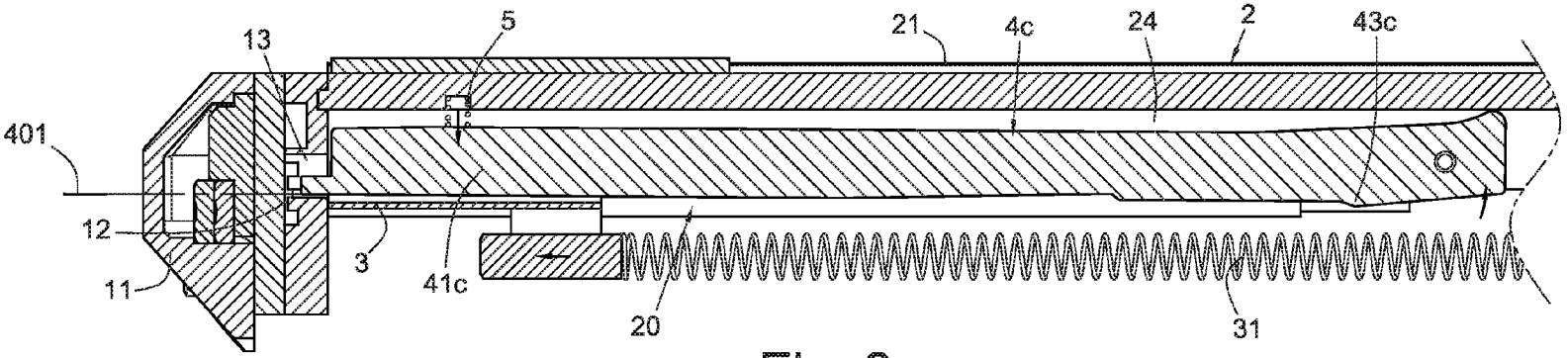
FIG. 9 is one action view of FIG. 8.

4. In the moment when the long nails 6 in the nail slot 20 are exhausted (as shown in FIG. 9), the nail pushing portions 41*a*, 41*b* and 41*c* of the positioning pieces 4*a*, 4*b* and 4*c* may oscillate to the first position 401.

When users want to fill the short nails 6*b* (as shown in FIG. 6), they can operate by the steps 1-4 mentioned above. However, because the short nails 6*b* are shorter than the long nails 6, the short nails 6*b* may be positioned between the bottom of the nail pushing portion 41*b* of the positioning piece 4*b* and the top of the anti-abrasive board 23. As a result, users can choose a low of nails of different length 6 or 6*b* in the nail slot 20 of the magazine 2. The positioning pieces 4, 4*a*, 4*b* and 4*c* may automatically check and adjust the height of the nail slot 20 to limit the position of the long nails 6 or short nails 6*b*.

The above description is given by way of example, and not limitation to disclose the necessary technology of the present application. By opening or closing the magazine 2, the nail pushing piece 3 may be pushed and discharge the producing portion 43, 43*a*, 43*b* and 43*c*. As a result, the nail pushing portions 41, 41*a*, 41*b* and 41*c* may accompany with the positioning pieces 4, 4*a*, 4*b*, 4*c* to oscillate to the first position 401 and the second position 402 and thus, to control the height of the nail slot 20 to limit the movement of the nails. This application may solve the issue that the traditional nail pushing piece focuses its force on one end of the pressing strip which is away from the perforation 12 and as a result, the pressing strip is swung and cannot totally open the nail slot. In addition, in the present application, the positioning pieces 4, 4*a*, 4*b* and 4*c* may prevent the nails from moving laterally, being inclined or shaking in order to prevent the nail gun from being jammed by nails and therefore to increase the reliability of the nailing of the nail gun. Moreover, the positioning pieces 4, 4*a*, 4*b* and 4*c* may bear the elastic force to be pivotally connected to the magazine 2 and a single spring 5 may be used to drive the positioning pieces 4, 4*a*, 4*b* and 4*c* to oscillate, which may simplify the number of the positioning member of the nail, save the manufacture cost and increase the manufacture efficiency.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A nail positioning member of a nail slot of a nail gun, comprising:

a magazine including a horizontal nail slot, the nail slot including a row nails and being connected with a perforation for nailing at the bottom of a gun body of the nail gun;

a nail pushing piece, bearing an elastic force in the direction of the perforation to slidably assembled to the nail slot;

a plurality of horizontal slot channels parallel to each other, the slot channels being formed in the magazine, being connected to the nail slot and being parallel to the nail slot; and a plurality of positioning pieces, respectively assembled to the slot channels, both ends of each positioning piece being positioned with a nail pushing position close to the perforation and a pivotal portion away from the perforation, each positioning piece bearing an elastic force to be pivotally connected to the nail slot by the pivotal portion, and in turn to drive the nail pushing portion to oscillate in the direction of the nail slot to a first position capable of blocking a nail head of the nail, the positioning piece between the nail pushing portion and the pivotal portion forming a protruding portion in a movement path of the nail pushing piece, the nail pushing piece, away from the protruding portion, pushing the protruding portion and driving the nail pushing portion to oscillate in the direction of the slot channel to a second position capable of opening the nail slot for placing the nails.

2. The nail positioning member according to claim 1, wherein the slot channel is connected with the perforation, and the nail pushing portion of the positioning piece extends to the gun body close to the perforation.

3. The nail positioning member according to claim 1, wherein the inside wall of the nail channel and the nail pushing portion forms a spring in between, and the positioning piece bears an elastic force by the spring.

4. The nail positioning member according to claim 3, wherein the inside wall of the slot channel forms a positioning aperture capable of locating the spring, and the spring is positioned inside of the positioning aperture.

5. The nail positioning member according to claim 3, wherein the nail pushing portion is driven by the spring in the direction of the nail slot and push the nail of the nail slot.

6. The nail positioning member according to claim 1, wherein the protruding portion is exposed in the nail slot.

* * * * *